US011324991B2

(12) United States Patent
Hsieh

(10) Patent No.: US 11,324,991 B2
(45) Date of Patent: May 10, 2022

(54) FOOTREST FOR ROWING MACHINE

(71) Applicant: Chin-Long Hsieh, Taichung (TW)

(72) Inventor: Chin-Long Hsieh, Taichung (TW)

( * ) Notice: Subject to any disclaimer, the term of this patent is extended or adjusted under 35 U.S.C. 154(b) by 0 days.

(21) Appl. No.: 16/934,080

(22) Filed: Jul. 21, 2020

(65) Prior Publication Data

US 2022/0023706 A1 Jan. 27, 2022

(51) Int. Cl.
*A63B 21/00* (2006.01)
*A63B 22/00* (2006.01)

(52) U.S. Cl.
CPC ..... *A63B 21/4034* (2015.10); *A63B 22/0076* (2013.01)

(58) Field of Classification Search
CPC ..... A63B 21/4034; A63B 21/4033; A63B 22/0076–0087; A63B 22/0605–2022/0658; B62M 3/086; B63H 16/02; B63B 34/00
See application file for complete search history.

(56) References Cited

U.S. PATENT DOCUMENTS

| | | | | |
|---|---|---|---|---|
| 6,231,485 | B1 * | 5/2001 | Dreissigacker | A63B 21/227 482/57 |
| 7,552,695 | B1 * | 6/2009 | Matsueda | B63H 16/02 114/363 |
| 9,375,604 | B2 * | 6/2016 | Yeh | A63B 22/0046 |
| 10,730,583 | B2 * | 8/2020 | Donahue | B62M 3/083 |
| 10,960,954 | B1 * | 3/2021 | Snider | B62M 3/083 |
| 2009/0205556 | A1 * | 8/2009 | Kawahara | B63H 16/02 114/363 |
| 2009/0241827 | A1 * | 10/2009 | Matsueda | A43B 5/08 114/363 |
| 2013/0139745 | A1 * | 6/2013 | Machida | A43B 5/08 36/134 |
| 2017/0106957 | A1 * | 4/2017 | Schauble | B63H 16/02 |

* cited by examiner

*Primary Examiner* — Joshua Lee
*Assistant Examiner* — Catrina A Letterman

(57) ABSTRACT

A footrest includes a base plate, two supports and two clipless pedals. The base plate has a first set of adjustment holes arranged in two rows. Each of the supports has a bottom and a pivoting seat. The bottom has two fixing holes corresponding to the first set of adjustment holes in two rows. The pivoting seat has a pivoting hole. Each of the supports is fixed onto the base plate by fastening bolts passing through the fixing holes and selective two of the first set of adjustment holes. The clipless pedals are separately screwed into the pivoting holes.

3 Claims, 7 Drawing Sheets

FOOTREST FOR ROWING MACHINE

TECHNICAL FIELD

The invention relates to rowing machines, particularly to a rowing machine with adjustable pedals.

RELATED ART

A conventional rowing exercise machine 30 as shown in FIG. 7 is provided with fixed pedals 31. The pedals 31 cannot completely secure a user's feet. When exercising, a user's feet are unable to exert force effectively. And a wrong angle of exerting force may cause a sports injury. Some exercise equipment such as a stationary bike is equipped with clipless pedals and other exercise equipment such as a rowing machine adopts normal pedals 31. Users who use these exercise equipment with different pedals must prepare and change different shoes. This is very inconvenient for users.

SUMMARY OF THE INVENTION

An object of the invention is to provide a footrest for a rowing machine, which has clipless pedals for effectively and stably fixing feet of a user.

Another object of the invention is to provide a footrest for a rowing machine, which has adjustable pitch between two pedals for fitting different users.

To accomplish the above objects, the footrest for a rowing machine of the invention includes a base plate, two supports and two clipless pedals. The base plate has a first set of adjustment holes arranged into two rows. Each of the supports has a bottom and a pivoting seat. The bottom has two fixing holes corresponding to the first set of adjustment holes in two rows. The pivoting seat has a pivoting hole. Each of the supports is fixed onto the base plate by fastening bolts passing through the fixing holes and selective two of the first set of adjustment holes. The clipless pedals are separately screwed into the pivoting holes.

DETAILED DESCRIPTION OF THE INVENTION

Figure 1:
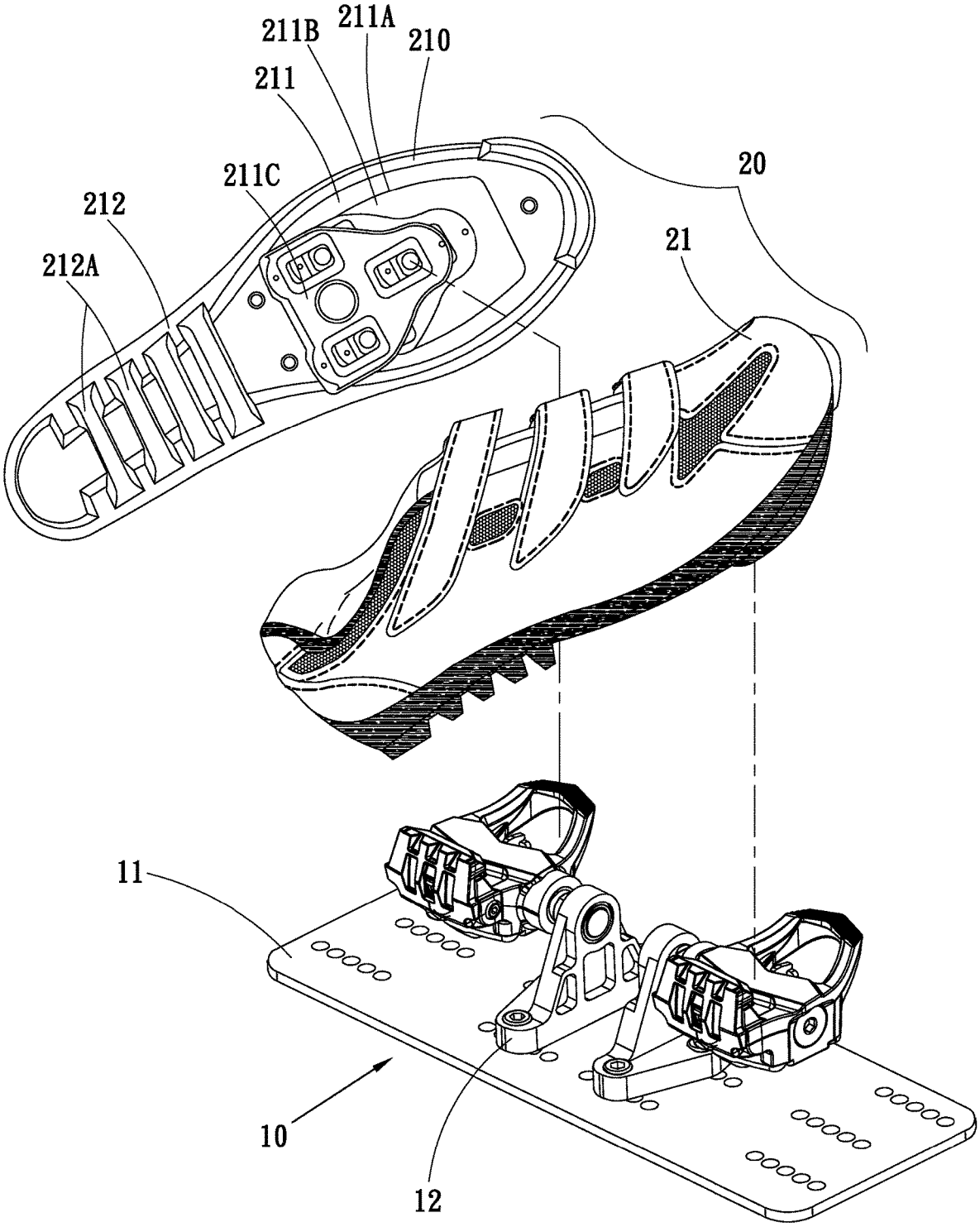
FIG. 1 is a schematic view of the footrest and shoes of the invention.
Figure 2:
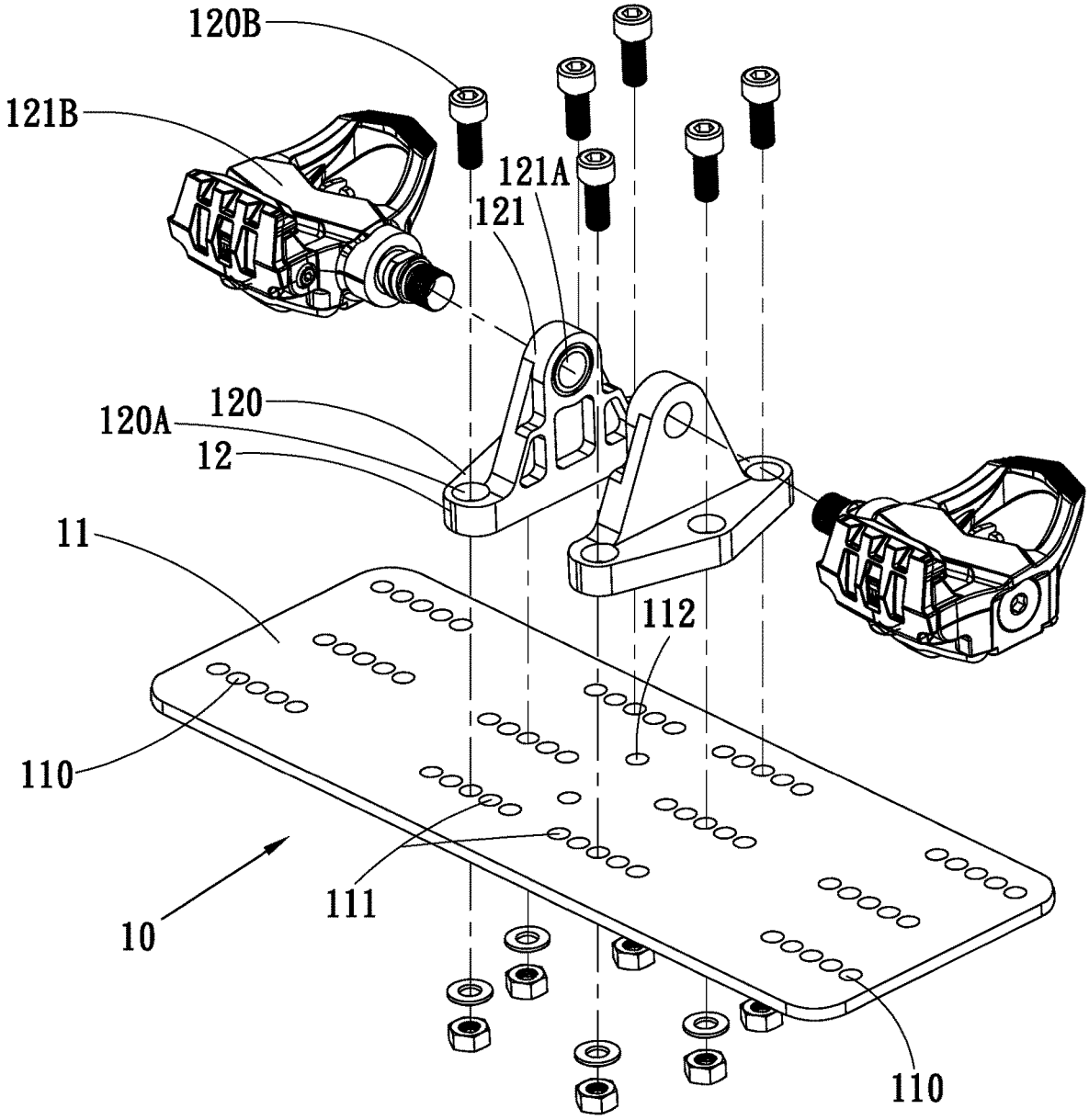
FIG. 2 is an exploded view of the footrest of the invention.
Figure 5:
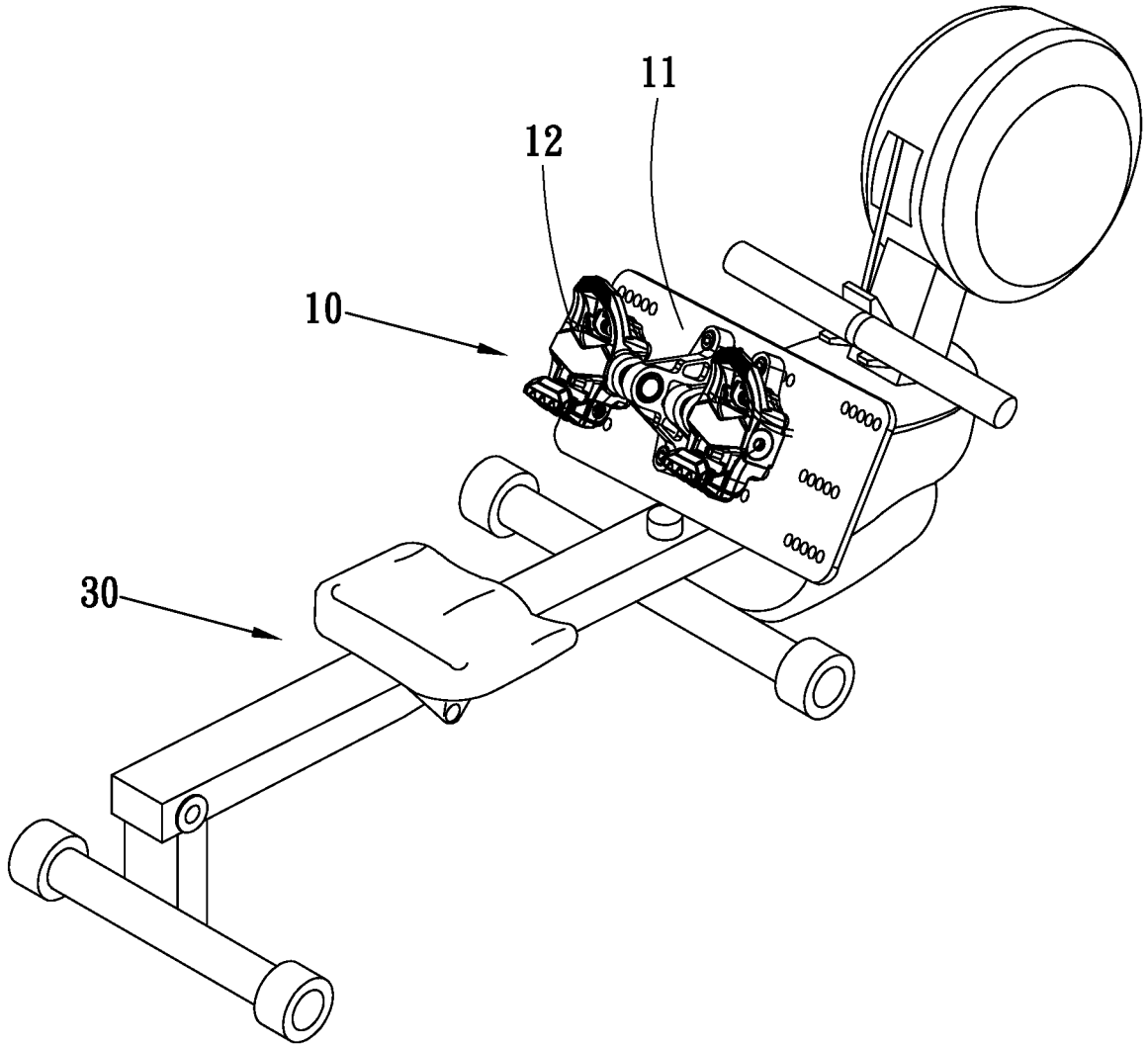
FIG. 5 is a schematic view of the invention installed in a rowing machine.

Please refer to FIGS. 1 and 2. The footrest 10 for a rowing machine of the invention includes a base plate 11, two supports 12 and two clipless pedals 121B. The base plate 11 has a first set of adjustment holes 110 and a second set of adjustment holes 111. Each of the first set of adjustment holes 110 and the second set of adjustment holes 111 is arranged into at least two rows. In the shown embodiment, each of the first set of adjustment holes 110 and the second set of adjustment holes 111 is arranged into three rows. The second set of adjustment holes 111 is beside the first set of adjustment holes 110. The second set of adjustment holes 111 aligns with the first set of adjustment holes 110. The base plate 11 is provided with two connecting holes 112 for being fastened to a rowing machine 30 as shown in FIG. 5 by two bolts.

It is noted that the second set of adjustment holes 111 is omissible. Also, a longer set of adjustment holes, whose length is equivalent to the sum of the first set of adjustment holes 110 and the second set of adjustment holes 111, is available.

Each of the two supports 12 has a bottom 120 and a pivoting seat 121. The bottom 120 has at least two fixing holes 120A corresponding to the first set of adjustment holes 110 in two rows and second set of adjustment holes 111 in two rows. In the shown embodiment, the fixing holes 120A are three in number for corresponding to the first set of adjustment holes 110 in three rows and the second set of adjustment holes 111 in three rows. Each of the supports 12 is fixed onto the base plate 11 by fastening bolts 120B passing through the fixing holes 120A and selective two or three of either the first set of adjustment holes 110 or the second set of adjustment hole 111.

The pivoting seat 121 has a pivoting hole 121A. Each of the clipless pedals 121B is screwed into one of the pivoting holes 121A. The clipless pedals 121B may adopt those types used for road or mountain bicycles for better availability.

Figure 3:
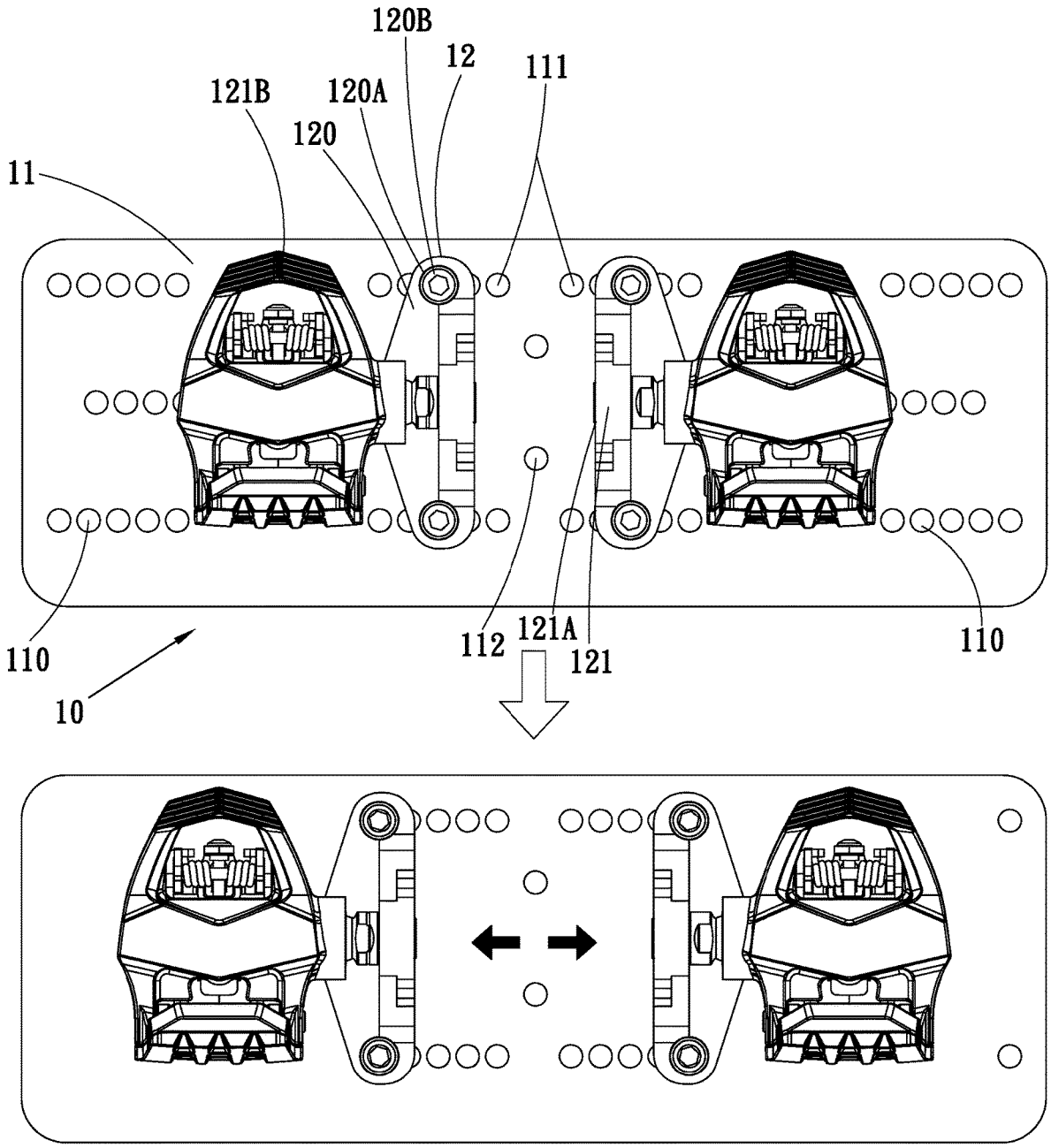
FIG. 3 is a schematic plan view showing pitch adjustment of two pedals of the footrest of the invention.
Figure 4:
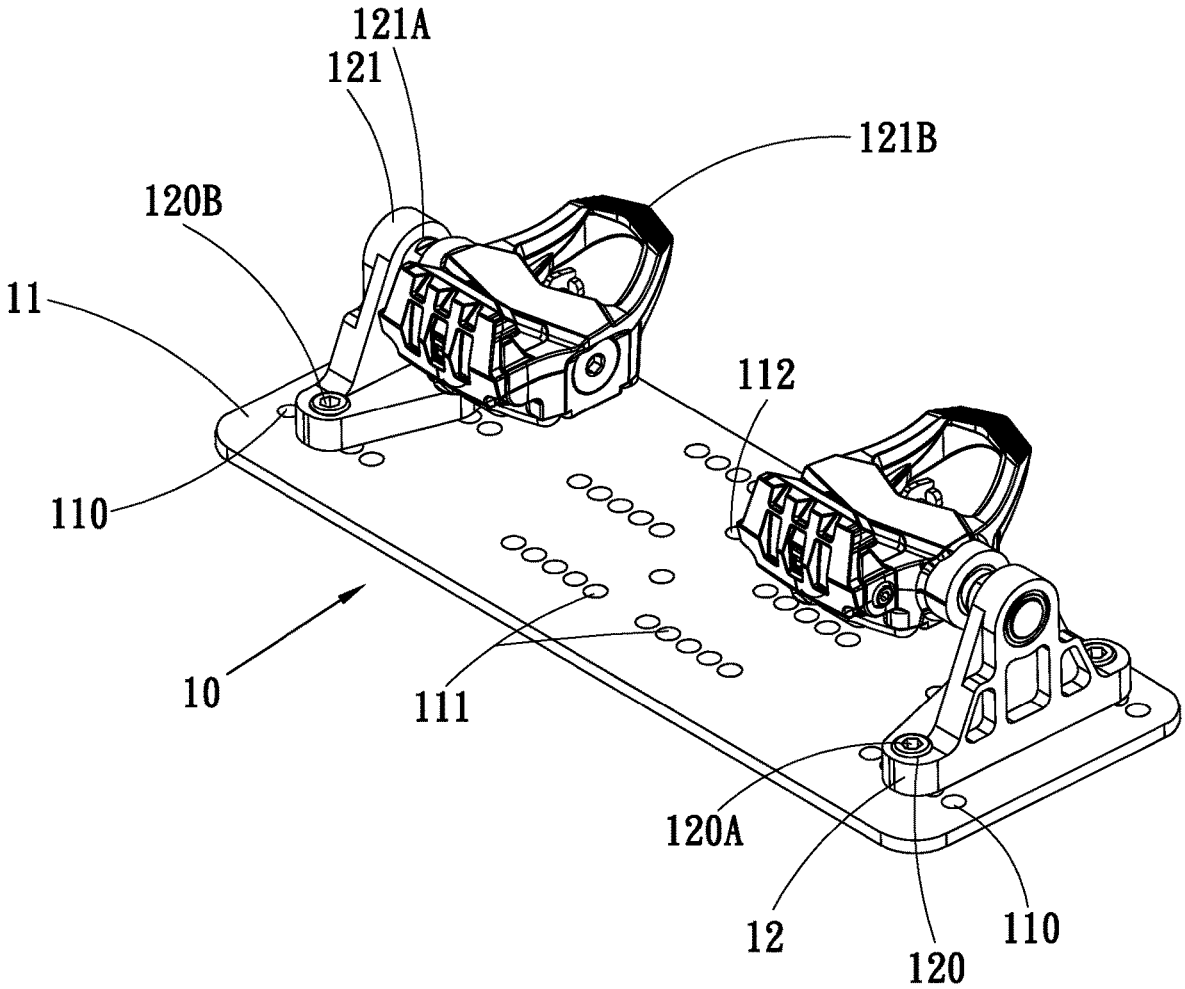
FIG. 4 is a schematic perspective view showing pitch adjustment of two pedals of the footrest of the invention.

Please refer to FIGS. 3-5. The footrest 10 is fastened to a rowing machine 30 through the connecting holes 112. The supports 12 are fixed into corresponding two or three holes of either the first set of adjustment holes 110 or the second set of adjustment hole 111. Selecting two or three holes of either the first set of adjustment holes 110 or the second set of adjustment hole 111 causes adjustment of pitch between the clipless pedals 121B. A shoe body 21 of shoes 20 worn by a user is provided with a cleat 211C. The cleat 211C detachably engages with the clipless pedal 121B for fastening feet of a user.

A pair of shoes 20 has two shoe bodies 21. The bottom of the shoe body 21 has a sole 210 with a sole front 211 and a sole rear 212. The sole front 211 has a recess 211A for receiving a fixing plate 211B. The cleat 211C is fixed on the fixing plate 211B. The fixing plate 211B is made of rigid material. The sole rear 212 is made of a soft material and is provided with flexible ribs 212A.

The supports 12 fixed on the first set of adjustment holes 110 as shown in FIG. 4 are opposite to being fixed on the second set of adjustment holes 111 as shown in FIGS. 1-3. That is why two sets of adjustment are disposed. The pitch adjustment of the clipless pedals 121B can be continuous by reversing the supports 12 on the first set of adjustment holes 110 or the second set of adjustment holes 111.

Figure 6:
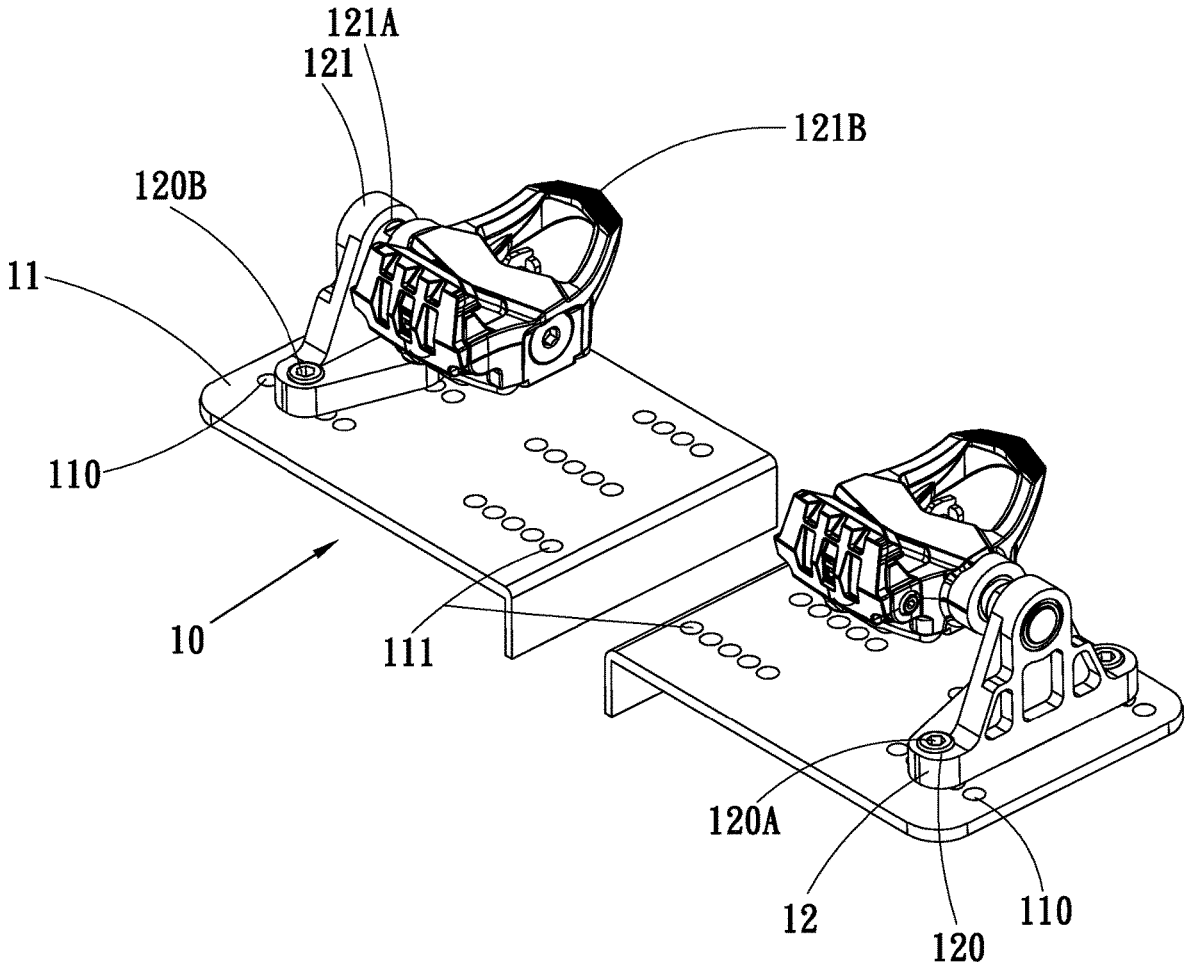
FIG. 6 is a schematic view of the footrest with a divided bottom plate of the invention.
Figure 7:
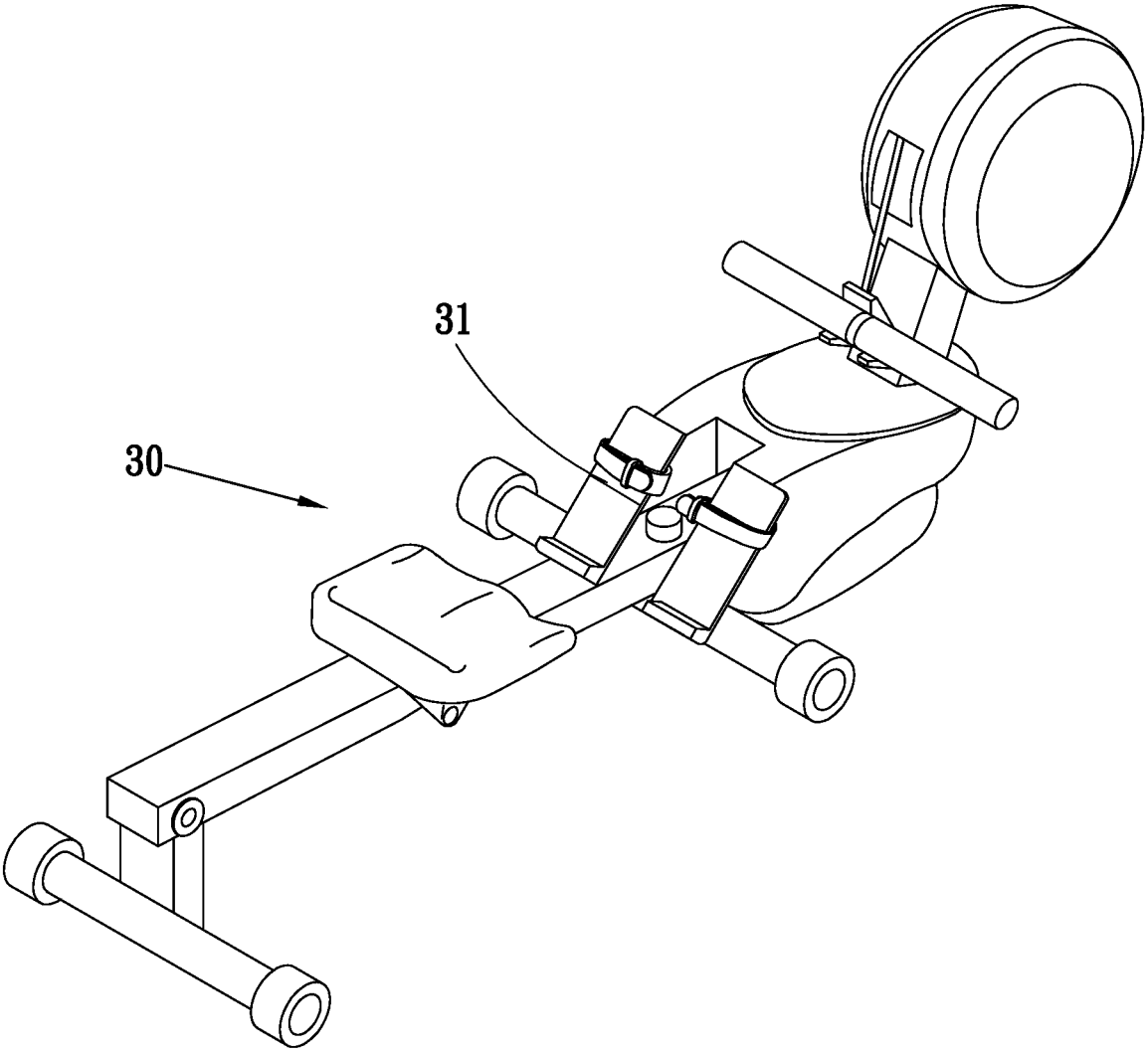
Fig. 7 (Prior Art)
FIG. 7 is a schematic view of a rowing machine with a conventional footrest.

Please refer to FIG. 6. The bottom plate 11 may also be divided into two pieces.

What is claimed is:

1. A footrest for a rowing machine, comprising:

a base plate, being a single piece, having a first set of adjustment holes arranged in two rows, each row comprising at least two adjustment holes, and the two rows being parallel to each other;

two supports, each being an L-shaped body comprised of a bottom and a pivoting seat, the bottom having two fixing holes, each fixing hole corresponding to one of the two rows of the first set of adjustment holes, and the pivoting seat having a pivoting hole, wherein each of the two supports is directly fixed onto the base plate by fastening bolts passing through the fixing holes and one of the at least two adjustment holes of the corresponding row of the first set of adjustment holes; and two clipless pedals, each having a pedal body and a spindle, an outer end of each spindle being screwed into the pivoting hole of the pivoting seat of the corresponding support, wherein the base plate is under the two clipless pedals.

2. The footrest of claim 1, wherein the base plate is provided with two connecting holes for being fastened to the rowing machine.

3. The footrest of claim 1, further comprising a second set of adjustment holes beside the first set of adjustment holes, the second set of adjustment holes being arranged in two rows, each row comprising at least two adjustment holes, and the two rows being parallel to each other and separately aligned with the two rows of the first set of adjustment holes, and each of the two supports being fixed onto the base plate by fastening bolts passing through the fixing holes and two of either the first set of adjustment holes or the second set of adjustment holes.

* * * * *